US006220885B1

(12) United States Patent
Lemberger et al.

(10) Patent No.: US 6,220,885 B1
(45) Date of Patent: Apr. 24, 2001

(54) SAFETY LOCKING SYSTEM FOR ELECTRICAL PLUGS

(75) Inventors: Gary Lemberger, 100 NW. 82nd Ave., Plantation, FL (US) 33324; Michael M. Anthony, Parkland, FL (US)

(73) Assignee: Gary Lemberger, Plantation, FL (US)

( * ) Notice: Subject to any disclaimer, the term of this patent is extended or adjusted under 35 U.S.C. 154(b) by 0 days.

(21) Appl. No.: 09/621,792

(22) Filed: Jul. 21, 2000

(51) Int. Cl.[7] ..... H01R 13/625
(52) U.S. Cl. ..... 439/346
(58) Field of Search ..... 439/346, 347, 439/133, 134, 135

(56) References Cited

U.S. PATENT DOCUMENTS

| | | | | |
|---|---|---|---|---|
| 4,812,131 | * | 3/1989 | Sieverman | 439/134 |
| 4,957,446 | * | 9/1990 | Belsky | 439/134 |
| 5,055,057 | * | 10/1991 | Boyer | 439/134 |
| 5,073,122 | * | 12/1991 | Burke, Jr. | 439/134 |
| 5,129,836 | * | 7/1992 | Ursich | 439/346 |
| 5,176,527 | * | 1/1993 | Herbert | 439/134 |
| 5,281,162 | * | 1/1994 | Ursich | 439/346 |
| 5,330,361 | * | 7/1994 | Brend | 439/134 |
| 5,409,393 | * | 4/1995 | Perkins et al. | 439/347 |
| 5,480,318 | * | 1/1996 | Garrison | 439/346 |
| 5,666,829 | * | 9/1997 | Aikens | 70/57 |
| 5,941,724 | * | 8/1999 | Reed | 439/346 |

* cited by examiner

*Primary Examiner*—Tulsidas Patel
(74) *Attorney, Agent, or Firm*—Oltman, Flynn & Kubler

(57) ABSTRACT

A plug engagement apparatus for engaging and conducting electricity into an electric plug having plug prongs, the prongs having prong free ends with prong openings includes a prong retaining mechanism for receiving and retaining at least one of the plug prongs; and a slide bolt structure including at least one locking bolt and a locking bolt constraining structure for constraining the locking bolt to slide relative to the prong retaining mechanism and into the prong opening in the plug prong, so that the plug prong is engaged against removal from the prong retaining mechanism, and where the locking bolt constraining structure constrains the locking bolt to slide relative to the prong retaining mechanism and out of the prong opening in the plug prong, so that the plug prong is released and removable from the prong retaining mechanism; where the locking bolt constraining structure includes a mounting structure, so that the locking bolt constraining structure constrains the slide bolt structure to slide relative to the face plate, so that the locking bolt slides to enter the prong opening and thus locks the at least one prong within the apparatus.

20 Claims, 11 Drawing Sheets

SAFETY LOCKING SYSTEM FOR ELECTRICAL PLUGS

BACKGROUND OF THE INVENTION

1. Field of the Invention

The present invention relates generally to the field of electrical conduction mechanisms for delivering electricity to homes and businesses. More specifically the present invention relates to a cord plug engagement apparatus such as a wall outlet for receiving and engaging prongs of appliance cord plugs and delivering electric current into at least one of the prongs, the apparatus having locking means which lock the prongs into the apparatus to prevent plug removal and insertion of objects by children. The essential elements of the apparatus are a face plate having prong passing ports and a face plate front surface and a face plate rear surface, a slide bolt structure constrained by mounting means on the face plate rear surface to slide parallel to the face plate, with locking bolts which slide to enter prong openings at the prong free ends and thus to lock the prongs within the apparatus, and a slide bolt structure displacement mechanism for manual movement by a user which in turn moves the slide bolt structure so that the bolts enter or retract from the prong openings. A bolt stop structure is optionally provided which obstructs the movement of the bolts across the prong entry paths prior to insertion of prongs into the apparatus, so that the prongs do not strike and damage the bolts during insertion.

2. Description of the Prior Art

There have long been plug prong engaging receptors such as outlets for releasibly holding the prongs of a cord plug within the outlet. These prior outlets and related structures have been in general inefficient and costly.

One such prior receptor is that of Ursich, U.S. Pat. No. 5,129,836, issued on Jul. 14, 1992. Ursich includes locking elements that are uniquely arranged to engage the typical punch holes provided in the male prongs of an electrical plug. Without other tools, the locking elements of the invention are locked in position by depression of an exterior arranged actuator which is also used to permit the plug to be easily removed.

Burke, Jr., U.S. Pat. No. 5,073,122, issued on Dec. 17, 1991, discloses a lock-out enclosure for power connectors. Burke, Jr. includes a tubular enclosure that is only slightly larger than the connector. A cap is installed on one end of the tubular enclosure. Installation of the cap onto the power line is made possible by a radial slot extending part way therethrough. After the cap is located on the power line, the tubular enclosure is slid over the connector and onto the cap. The cap is then permanently attached to the tubular enclosure using the adhesive or locking means to form an enclosure locking assembly. The enclosure assembly is slid over the associated connector to prevent access to the connector.

Boyer, U.S. Pat. No. 5,055,057, issued on Oct. 8, 1991, reveals an electric plug lock. Boyer includes a device which has bolt portions which removably slide into the openings provided at the distal end of virtually all cord plug prongs to lock the plug prongs into the device. Ursich, U.S. Pat. No. 5,281,162, issued on Jan. 25, 1994, discloses another variation of the prong opening engaging bolts in a receptor, which in this instance are metal balls which ride into the prong openings upon lock engagement.

Other generally related art includes Sleverman, U.S. Pat. No. 4,812,131, issued on Mar. 14, 1989 for an electrical plug apparatus; Belsky, U.S. Pat. No. 4,957,446, issued on Sep. 18, 1990, for a lockout device for electrically operated equipment; Herbert, U.S. Pat. No. 5,176,527, issued on Jan. 5, 1993, for an apparatus for preventing the use of an electrical device; Brend, U.S. Pat. No. 5,330,361, issued on Jul. 19, 1994, for an electrical plug locking device; Perkins, et al., U.S. Pat. No. 5,409,393, issued on Apr. 25, 1995, for a locking mechanism for a ribbon cord; Aikens, U.S. Pat. No. 5,666,829, issued on Sep. 16, 1997, for a plug lock; Garrison, U.S. Pat. No. 5,480,318, issued on Jan. 2, 1996 for a childproof electrical plug; and Reed, U.S. Pat. No. 5,941,724, issued on Aug. 24, 1999, for a lockable female electrical receptacle.

It is thus an object of the present invention to provide a safety locking system which may take the form of plug prong engaging outlet, to prevent removal of the plug from the outlet by children and the consequent danger of insertion of some other object into the outlet.

It is another object of the present invention to provide such a locking system and apparatus which accepts conventional, standard plugs, so that no modification need by made to the vast numbers of existing appliance cords in use today.

It is still another object of the present invention to provide a locking system and apparatus which includes means for retracting electrical contacts out of the plug prong entry paths of plug prongs when the apparatus is not in use so that a foreign object fitted into any of the apparatus plug prong entry paths, such as by a child, does not make electrical contact and therefore does not cause injury.

It is finally an object of the present invention to provide such a system and apparatus which is relatively inexpensive to manufacture and which is sturdy, durable and easy to use.

SUMMARY OF THE INVENTION

The present invention accomplishes the above-stated objectives, as well as others, as may be determined by a fair reading and interpretation of the entire specification.

A plug engagement apparatus is provided for engaging and conducting electricity into an electric plug having plug prongs, the prongs having prong free ends with prong openings, the apparatus including a prong retaining mechanism for receiving and retaining at least one of the plug prongs; and a slide bolt structure including at least one locking bolt and a locking bolt constraining structure for constraining the locking bolt to slide relative to the prong retaining mechanism and into the prong opening in the plug prong, so that the plug prong is engaged against removal from the prong retaining mechanism, and where the locking bolt constraining structure constrains the locking bolt to slide relative to the prong retaining mechanism and out of the prong opening in the plug prong, so that the plug prong is released and removable from the prong retaining mechanism; where the locking bolt constraining structure includes a mounting structure, so that the locking bolt constraining structure constrains the slide bolt structure to slide relative to the face plate, so that the locking bolt slides to enter the prong opening and thus locks the at least one prong within the apparatus.

The prong retaining mechanism optionally includes an outlet face plate having a face plate prong passing port for each plug prong, and a face plate front surface and a face plate rear surface. The plug engagement apparatus preferably additionally includes a slide bolt structure displacement mechanism for manual movement by a user which in turn moves the locking bolt to enter and to retract from the prong opening. The apparatus preferably still additionally includes a bolt stop structure for obstructing movement of the locking bolt into the path of a prong entering the apparatus.

The slide bolt structure preferably includes two of the locking bolts for engaging two prong openings, and the face plate preferably includes a face plate securing structure for securing the face plate against a building wall; at least two tubular prong passageways protruding perpendicular to and rearwardly from the face plate rear surface, encircling the prong passing ports, the passageways being sized in diameter to fit around and thus to receive plug prongs, and being sized in length to permit free ends of the plug prongs to extend beyond and protrude rearwardly out of the passageways.

The locking bolt constraining structure includes a slide bolt structure support flange extending rearwardly from the face plate rear surface. The slide bolt structure support flange preferably extends around the prong passageways in a substantially circular configuration. The slide bolt structure preferably includes two of the locking bolts for engaging two prong openings and the slide bolt structure preferably includes a pair of opposing guide channels protruding rearwardly from the face plate rear surface and opening toward each other; a bolt slide panel including a central panel portion and having two guide slats protruding from opposing edges of the central panel portion and fitting into the guide channels, the guide slats having a length so that the bolt structure has room within the guide channels to slide laterally within the guide channels; and first and second electrical terminals laterally spaced apart from each other and secured to the bolt slide plate in electrical contact with the locking bolts so that the locking bolts protrude laterally from the terminals and are slidable simultaneously into and out of the prong openings; the electrical terminals being connectable to electrical wires external to the apparatus.

The apparatus preferably additionally includes a generally U-shaped resilient prong engagement clip having a clip port which fits around one of the locking bolts and is secured to the bolt slide panel; so that when the slide bolt structure is slid laterally within the guide channels toward the prongs, the locking bolts pass through the prong openings and the engagement clips simultaneously bear against corresponding prongs and snap over the prongs to enhance electrical conductive contact between the terminals and the prongs. The slide panel preferably has a stem port and the slide bolt structure displacement mechanism preferably includes curved slots forming segments of a circle in the face plate, surrounding the prong openings; an annular plate placed against the face plate front surface, and connected to the face plate with an annular plate guide structure constraining the annular plate to slide in rotation about the center of the annular plate, and at least one engagement leg protruding perpendicularly from the annular plate and rearwardly through the curved slot, protruding into the stem port in the slide panel, so that rotation of the annular plate by a user causes the at least one engagement leg to bear against the slide panel through the stem port and thereby to slide the slide panel and slide the locking bolts into and out of the prong openings. The annular plate preferably includes a forwardly extending gripping tab for engagement by user fingers to rotate the annular plate.

The bolt stop structure preferably includes a slat opening in each of the guide channels; and an anchor bar having two opposing anchor bar ends, each anchor bar end being bent to engagingly snap into one of the slat openings so that the anchor bar extends between the guide channels, the anchor bar having two substantially parallel and laterally spaced apart resilient stop arms extending from the anchor bar obstructing movement of the locking bolts behind the passageways when no prongs are in the passageways; so that as the prongs are inserted into the passageways, the prongs bear against and deflect the stop arms rearwardly and out of the paths of and locking bolts.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
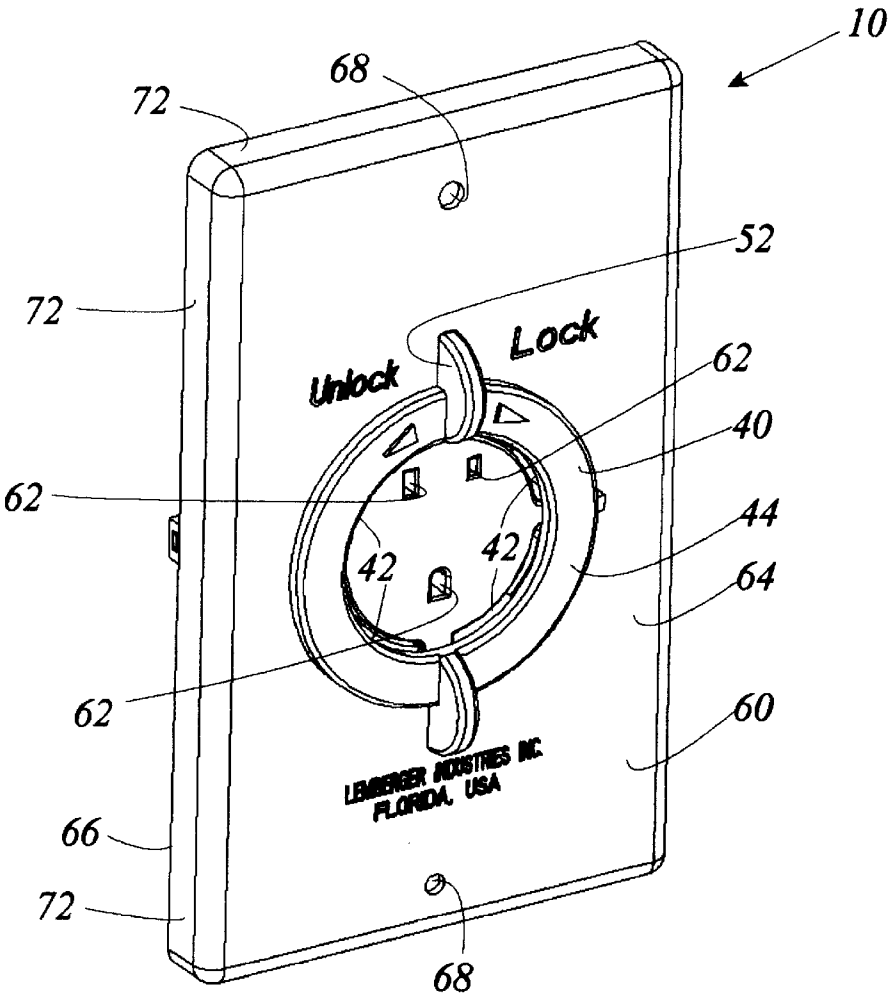
FIG. 1 is a front perspective view of the inventive apparatus showing the outlet face plate forward surface, the annular plate and tabs for operating the apparatus to lock and to release the prongs of a cord plug.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
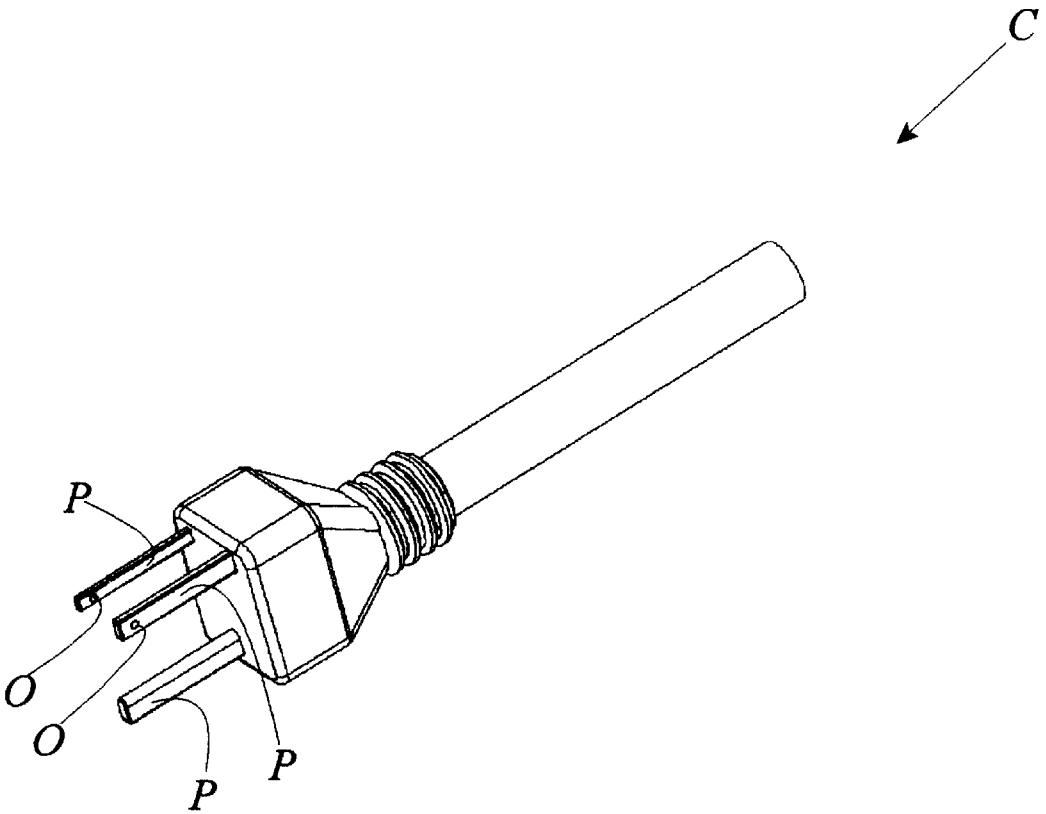
FIG. 2 is a perspective view of a conventional cord plug which the apparatus is intended to receive and engage.
Figure 3:
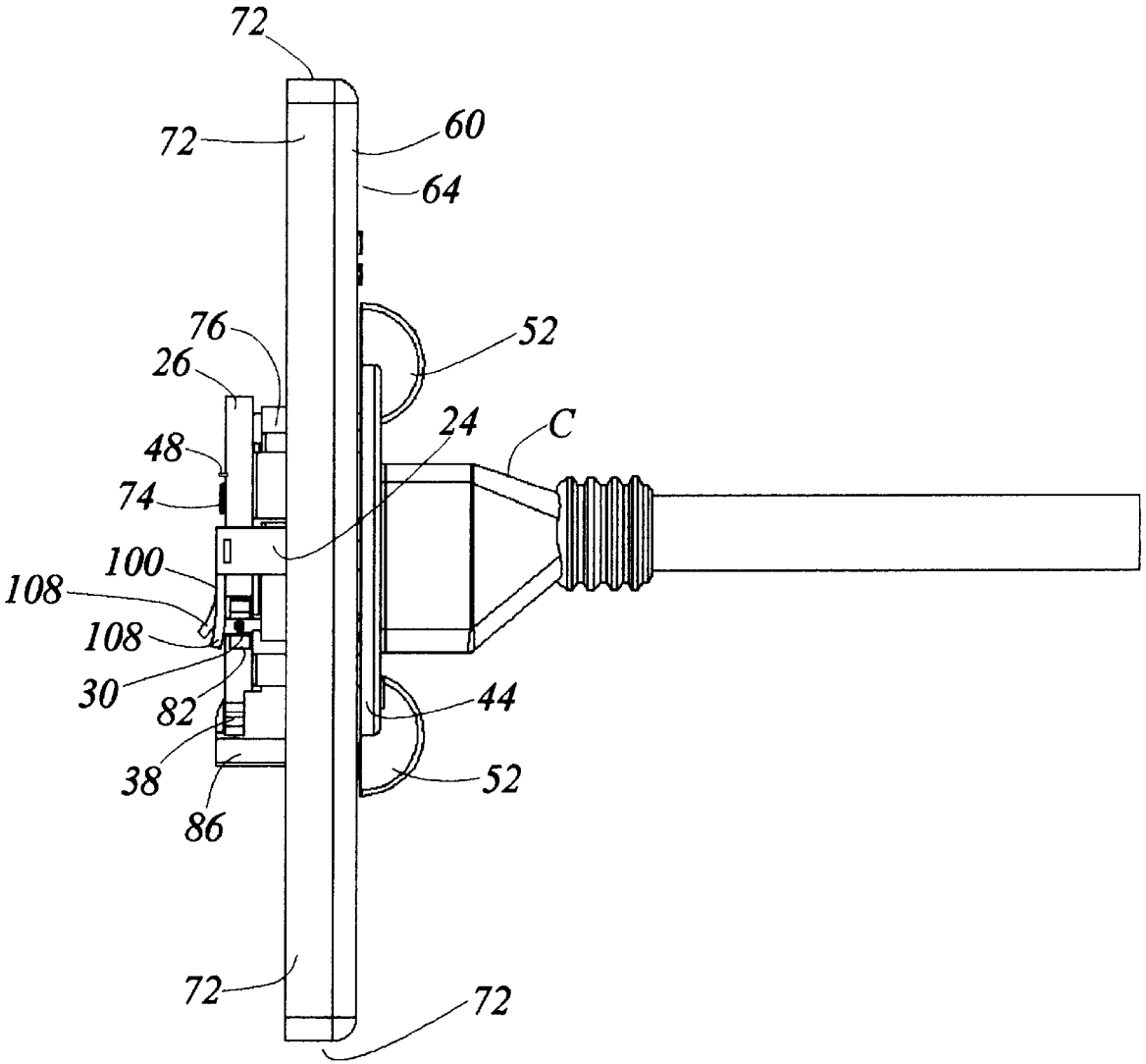
FIG. 3 is a side plan view of the apparatus, showing a conventional cord plug engagingly inserted into the apparatus.
Figure 4:
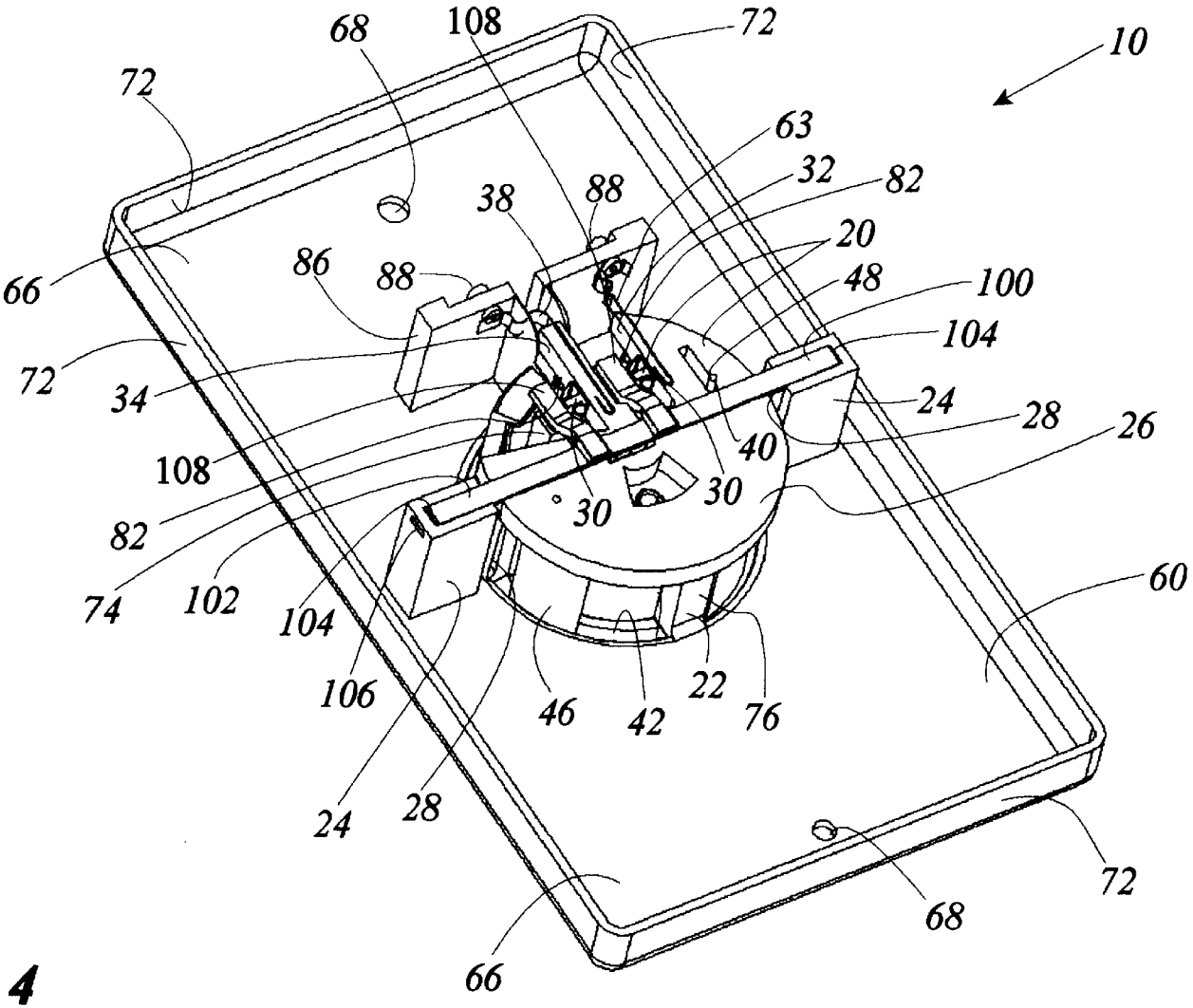
FIG. 4 is a rear, perspective view of the preferred embodiment of the apparatus, showing details of the slide bolt structure, the slide bolt structure displacement mechanism and the bolt stop structure.
Figure 5:
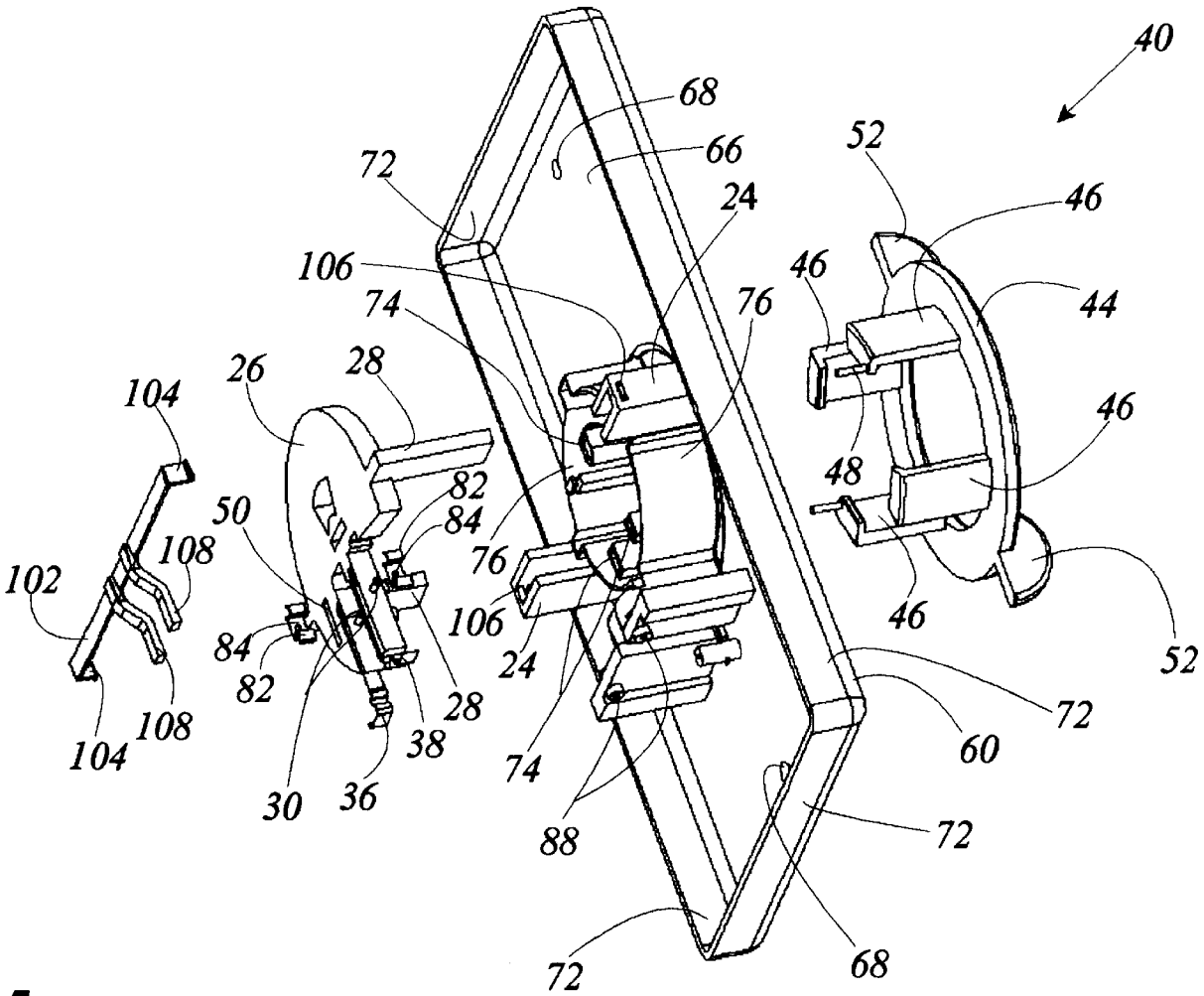
FIG. 5 is an exploded, perspective view of the apparatus, showing how the various essential structures fit together.
Figure 6:
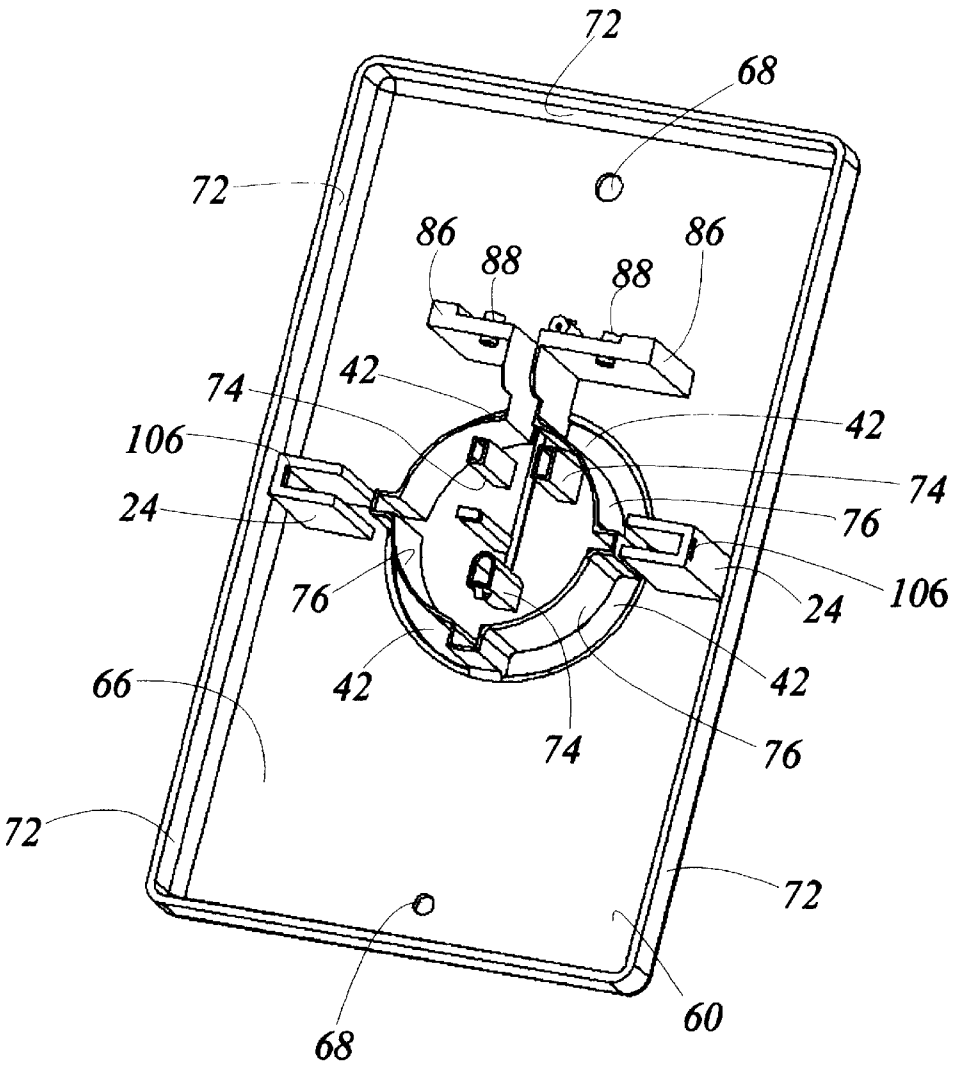
FIG. 6 is a rear, perspective view as in FIG. 4 with the elements not molded integrally with the face plate removed.
Figure 7:
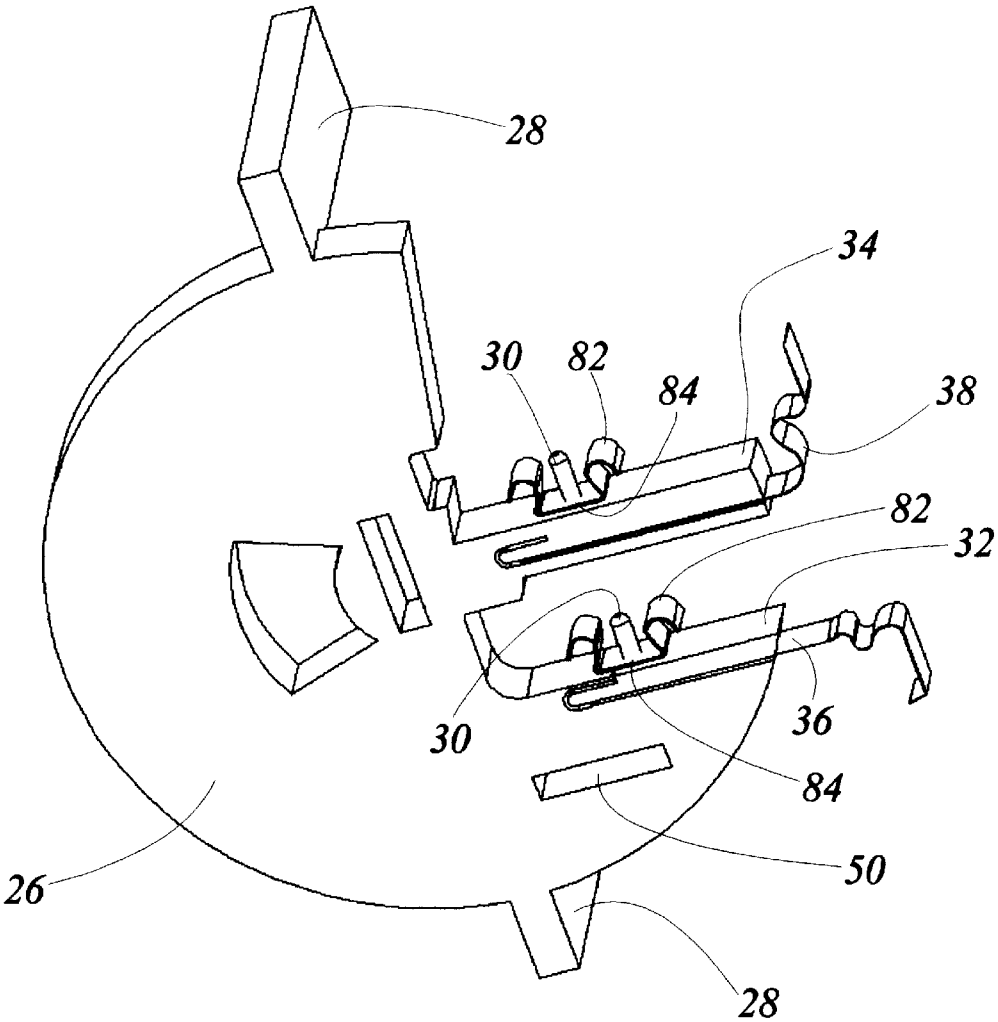
FIG. 7 is a perspective view of the slide bolt structure and attached terminals.
Figure 8:
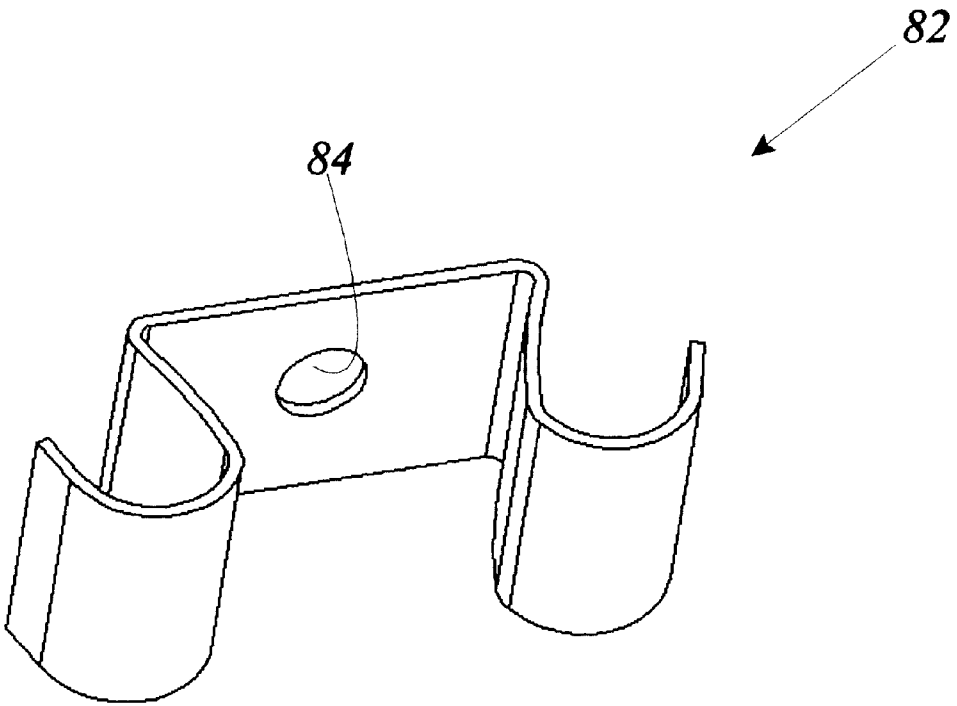
FIG. 8 is a close-up perspective view of one of the prong engagement clips which enhance electrical contact between the plug prongs and the outlet terminals.
Figure 9:
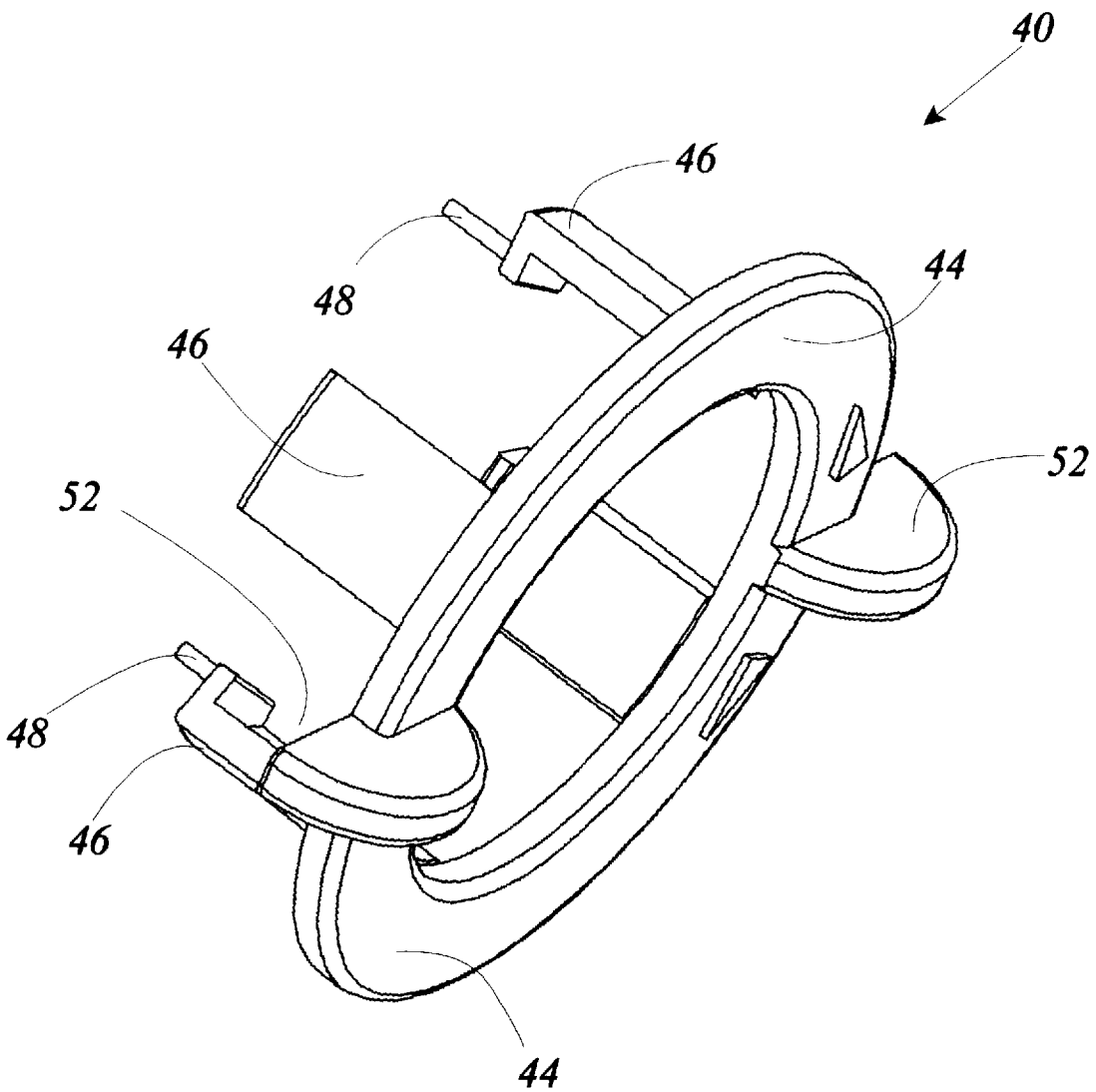
FIG. 9 is a close-up perspective view of the integrally formed portions of the slide bolt structure displacement mechanism.
Figure 10:
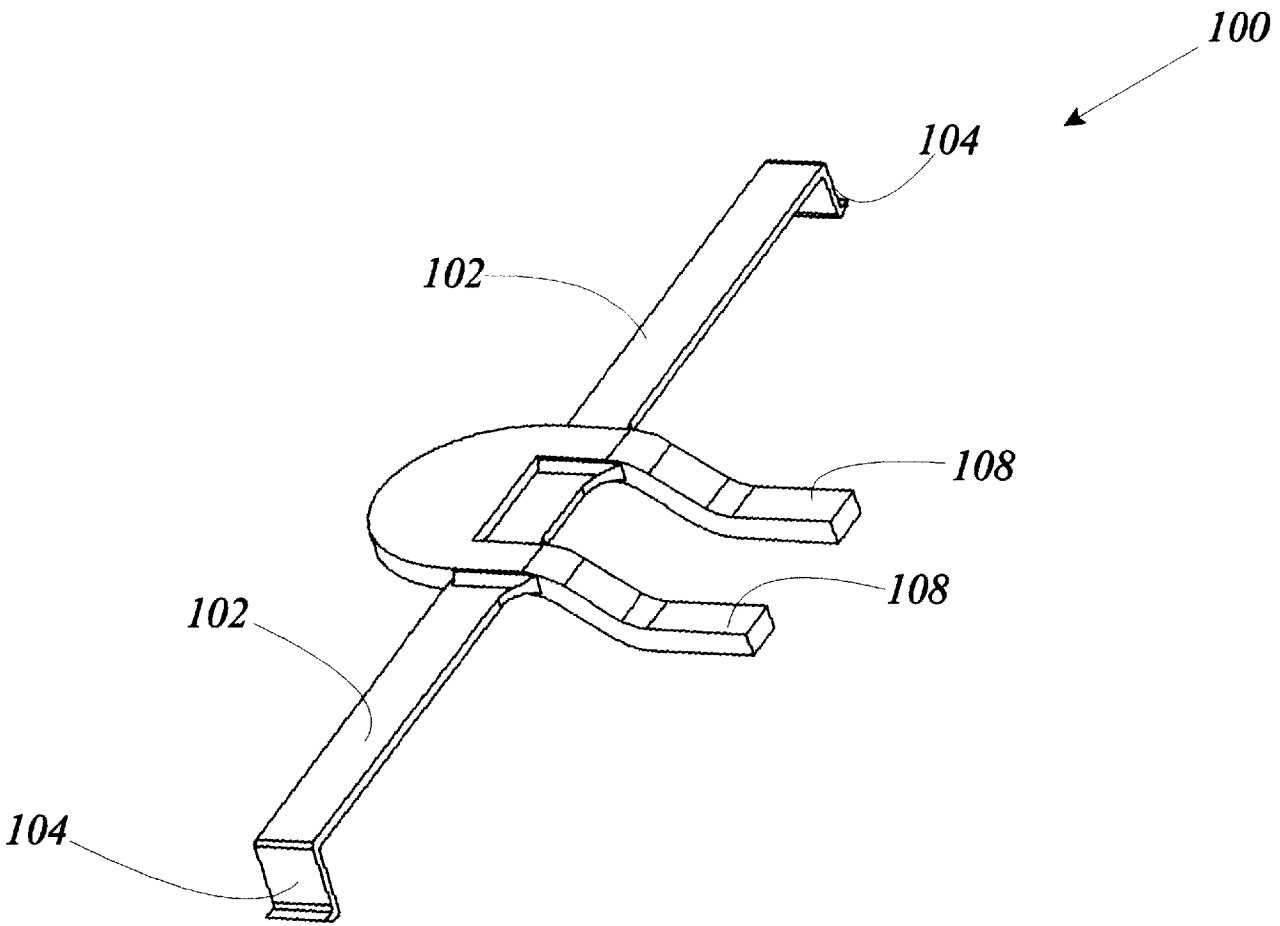
FIG. 10 is a close-up perspective view of the integrally formed portions of the bolt stop structure, including the anchor bar and stop arms.
Figure 11:
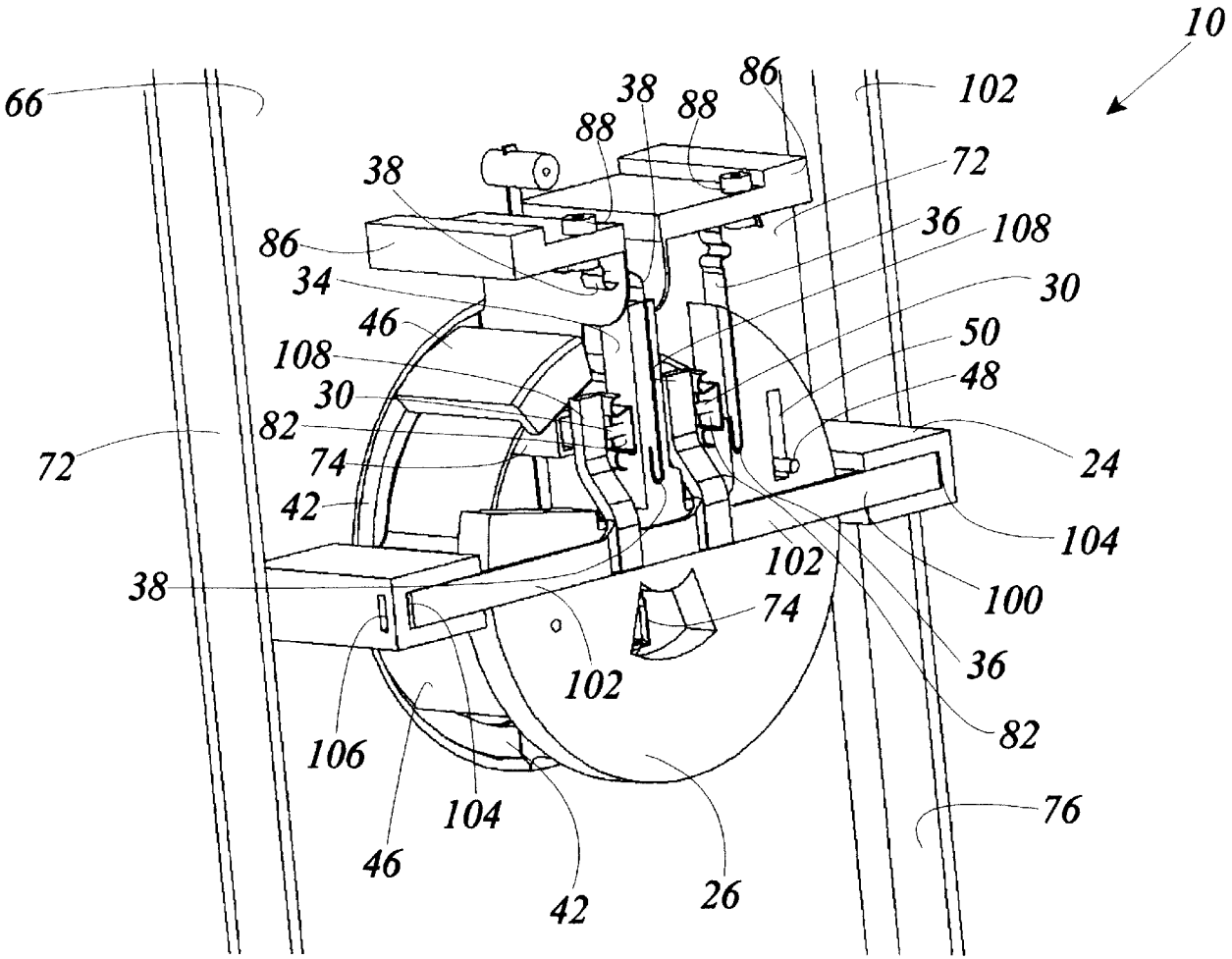
FIG. 11 is a view as in FIG. 4, but broken away and shown up close.

Referring to FIGS. 1–11, a plug engaging apparatus which preferably is configured as a wall outlet 10 is disclosed for receiving and delivering electric current into prongs P of an appliance cord plug C. Outlet 10 includes locking means which lock the prongs P into the outlet 10 to prevent removal of the prongs P and insertion of objects by children and to prevent inadvertent plug C removal, such as when an appliance cord is pulled taut during appliance use.

Outlet 10 includes an outlet face plate 60 having prong passing ports 62 and a face plate front surface 64 and a face plate rear surface 66, locking means in the form of a slide bolt structure 20 constrained by locking bolt constraining means including mounting means 22 on the face plate rear surface 66 to slide parallel to the face plate 60, the slide bolt structure 20 having locking bolts 30 which slide to enter prong openings O at the prong P free ends and thus to lock the prongs P within the outlet 10, a slide bolt structure displacement mechanism 40 for manual movement by the user which in turn moves the slide bolt structure 20 so that the bolts 30 enter or retract from the prong openings O. A bolt stop structure 100 is optionally provided which obstructs the movement of the bolts 30 across the prong entry paths prior to insertion of prongs P into the outlet 10, so that the prongs P do not strike and damage the bolts 30 during prong P insertion.

Face plate 60 is preferably a standard sized rectangular outlet face plate having standard anchor screw ports 68 at its longitudinal ends, and having a periphery flange 72 protruding rearwardly from its peripheral edge to abut a building wall surface W surrounding a wall outlet opening. At least two and preferably three tubular prong passageways 74 are integrally molded with and protrude perpendicular to and rearwardly from the face plate rear surface 66, encircling the prong passing ports 62. These passageways 74 are sized in diameter to closely fit around and thus receive standard plug prongs P, and are sized in length to permit the free ends of standard prongs P to extend beyond and protrude rearwardly out of the passageways 74 so that prong openings O are exposed. A slide bolt structure support flange 76 extends rearwardly from the face plate rear surface 66, preferably in a broken, circular configuration around all of the prong passageways 74.

The slide bolt structure 20 preferably includes a pair of opposing guide channels 24 protruding rearwardly and perpendicularly from rear surface 66 and opening toward each other. A bolt slide panel 26, which is preferably substantially circular, includes two guide slats 28 protruding perpendicularly from the plane of the slide panel 26 at opposing panel 26 edges, and these guide slats 28 fit into the guide channels 24 and are spaced apart from each other a certain distance relative to the spacing of the guide channels 24 such that there is space for the bolt structure 20 to slide laterally within the guide channels 24. Sections of the circular bolt slide panel 26 are cut away to leave a prong abutment mounting edge 32 and to leave a parallel terminal mounting arm 34, and a first linear metal terminal 36 is secured within a slit in the slide panel 26 extending along the mounting edge 32 and a second linear metal terminal 38 is secured within a slit in the arm 34. A locking bolt 30 protrudes laterally from each terminal 36 and 38, through and out of the bolt slide panel 26 the two bolts 30 protruding in the same direction so that they can be slid simultaneously into and out of prong openings O. A generally U-shaped resilient prong engagement clip 82 has a clip port 84 which fits around each of the bolts 30 and is bonded to the slide panel 26. When the slide bolt structure 20 is slid laterally within the guide channels 24 into a locking position, the locking bolts 30 enter the prong openings O and the side portions of the engagement clips 82 simultaneously spread as they bear against their respective prongs P and snap over the prongs P to enhance electrical conductive contact between the terminals 36 and 38 and the prongs P. The electrical terminals 36 and 38 extend out of the outer edge of the bolt slide panel 26 and are secured to a fixed terminal connection flange 86, formed integrally with the face plate 60, with combination rivet/screw anchor structures (not shown). Electrical harness wires (not shown) from within wall conduits (not shown) are screwed to the rivet/screw anchor structures 88 and thus are placed in electrical contact with the terminals 36 and 38.

The slide bolt structure displacement mechanism 40 preferably includes curved slots 42 forming segments of a circle in the face plate 60, surrounding the prong passing ports 62. The displacement mechanism 40 further includes an annular plate 44 for placement against the face plate front surface 64, the annular plate 44 having perpendicular engagement legs 46 protruding rearwardly through the curved slots 42 into the outlet box (not shown). The engagement legs 46 have rearwardly extending leg stems 48 at the rearward free ends which protrude through stem ports 50 in the slide panel 26. The annular plate 44 has finger tabs 52 at opposing points along the annular plate 44 which protrude forwardly for gripping by a user.

The bolt stop structure 100 preferably includes a resilient, elongate anchor bar 102 having two bent longitudinal bar ends 104, each of which engagingly snaps into a slat opening 106 in one of the guide channels. Two parallel and laterally spaced apart resilient stop arms 108 extend perpendicularly from the anchor bar 102 over the rearward ends of the prong passageways 74 and obstruct movement of the locking bolts 30 across the open passageway 74 free ends when no prongs P are in the passageways 74. As prongs P are inserted into each passageway 74, the prong P free ends bear against and deflect the stop arms 108 rearwardly, and out of the paths of the locking bolts 30.

Thus to set the outlet 10 lock, the user inserts the prongs P of a plug through the plate prong passing ports 62 and through the passageways 74 so that the prongs P deflect the stop arms 108 and to place the prong openings O into alignment with the locking bolts 30. Then the user grips the finger tabs 52 and rotates the annular plate 44 about the center point of the plate 44 and relative to the face plate 60, thereby causing the legs 46 and leg stems 48 to slide the slide panel 26 within the guide channels 24 so that the bolts 30 enter the prong openings O. Rotating the annular plate 44 in the opposite rotational direction causes the leg stems 48 to slide the slide panel 26 in the opposite direction so that the bolts 30 slide out of the prong openings O, thereby freeing the prongs P so that the plug C may be pulled out of outlet 10.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A plug engagement apparatus for engaging and conducting electricity into an electric plug having plug prongs, the prongs having prong free ends with prong openings, the apparatus comprising:

prong retaining means for receiving and retaining at least one of said plug prongs;

and a slide bolt structure comprising at least one locking bolt and a locking bolt constraining means for constraining said locking bolt to slide relative to said prong retaining means and into the prong opening in the plug prong, such that the plug prong is engaged against removal from said prong retaining means, and wherein said locking bolt constraining means constrains locking bolt to slide relative to said prong retaining means and out of the prong opening in the plug prong, such that the plug prong is released and removable from said prong retaining means; and wherein said locking bolt constraining means comprises a mounting structure constraining said slide bolt structure to slide relative to said face plate, such that said locking bolt slides to enter the prong opening and thus locks the at least one prong within the apparatus.

2. The plug engagement apparatus of claim 1, wherein said prong retaining means comprises an outlet face plate having a face plate prong passing port for each plug prong, and a face plate front surface and a face plate rear surface.

3. The plug engagement apparatus of claim 1, additionally comprising a slide bolt structure displacement means for manual movement by a user which in turn moves said locking bolt to enter and to retract from the prong opening.

4. The apparatus of claim 1, additionally comprising a bolt stop structure for obstructing movement of said locking bolt into the path of a prong entering the apparatus.

5. The apparatus of claim 2, wherein said slide bolt structure comprises two said locking bolts for engaging two prong openings, and wherein said face plate comprises:

face plate securing means for securing said face plate against a building wall;

at least two tubular prong passageways protruding perpendicular to and rearwardly from said face plate rear surface, encircling said prong passing ports, said passageways being sized in diameter to fit around and thus to receive plug prongs, and being sized in length to permit free ends of the plug prongs to extend beyond and protrude rearwardly out of said passageways.

6. The apparatus of claim 1, wherein said locking bolt constraining means comprises a slide bolt structure support flange extending rearwardly from said face plate rear surface.

7. The apparatus of claim 6, wherein said slide bolt structure support flange extends around said prong passageways in a substantially circular configuration.

8. The apparatus of claim 1, wherein said slide bolt structure comprises two said locking bolts for engaging two prong openings and wherein said slide bolt structure comprises:

a pair of opposing guide channels protruding rearwardly from said face plate rear surface and opening toward each other;

a bolt slide panel comprising a central panel portion and having two guide slats protruding from opposing edges of said central panel portion and fitting into said guide channels, said guide slats having a length such that said bolt structure has room within said guide channels to slide laterally within said guide channels;

and first and second electrical terminals laterally spaced apart from each other and secured to said bolt slide plate in electrical contact with said locking bolts such that said locking bolts protrude laterally from said terminals and are slidable simultaneously into and out of the prong openings; said electrical terminals being connectable to electrical wires external to said apparatus.

9. The apparatus of claim 8, additionally comprising a generally U-shaped resilient prong engagement clip having a clip port which fits around one said locking bolt and is secured to said bolt slide panel;

such that when said slide bolt structure is slid laterally within said guide channels toward the prongs, said locking bolts pass through the prong openings and the said engagement clips simultaneously bear against corresponding prongs and snap over the prongs to enhance electrical conductive contact between the said terminals and the prongs.

10. The apparatus of claim 9, wherein said slide panel has a stem port and wherein said slide bolt structure displacement means comprises:

curved slots forming segments of a circle in said face plate, surrounding said prong openings;

an annular plate placed against said face plate front surface, and connected to said face plate with annular plate guide means constraining said annular plate to slide in rotation about the center of said annular plate, and at least one engagement leg protruding perpendicularly from said annular plate and rearwardly through said curved slot, protruding into said stem port in said slide panel, such that rotation of said annular plate by a user causes said at least one engagement leg to bear against said slide panel through said stem port and thereby to slide said slide panel and slide said locking bolts into and out of the prong openings.

11. The apparatus of claim 10, wherein said annular plate comprises a forwardly extending gripping tab for engagement by user fingers to rotate said annular plate.

12. The apparatus of claim 8, wherein said bolt stop structure comprises:

a slat opening in each said guide channel;

and an anchor bar having two opposing anchor bar ends, each anchor bar end being bent to engagingly snap into one of said slat openings such that said anchor bar extends between said guide channels, said anchor bar having two substantially parallel and laterally spaced apart resilient stop arms extending from said anchor bar obstructing movement of said locking bolts behind said passageways when no prongs are in said passageways;

such that as the prongs are inserted into said passageways, the prongs bear against and deflect said stop arms rearwardly and out of the paths of and locking bolts.

13. A plug and engagement apparatus, comprising:

an electric plug having plug prongs, said prongs having prong free ends with prong openings;

prong retaining means for receiving and retaining at least one of said plug prongs;

and a slide bolt structure comprising at least one locking bolt and locking bolt constraining means for constraining said locking bolt to slide relative to said prong retaining means and into said prong opening in said plug prong, such that said plug prong is engaged against removal from said prong retaining means, and wherein said slide bolt structure constraining means constrains locking bolt to slide relative to said prong retaining means and out of the prong opening in the plug prong, such that the plug prong is released and removable from said prong retaining means; and wherein said locking bolt constraining means comprises a mounting structure on the face plate rear surface constraining said slide bolt structure to slide relative to said face plate, such that said locking bolt slides to enter the prong opening and thus locks the at least one prong within the apparatus.

14. The plug engagement apparatus of claim 13, wherein said prong retaining means comprises an outlet face plate having a face plate prong passing port for each plug prong, and a face plate front surface and a face plate rear surface.

15. The plug engagement apparatus of claim 13, additionally comprising a slide bolt structure displacement means for manual movement by a user which in turn moves said locking bolt to enter and to retract from the prong opening.

16. The apparatus of claim 13, additionally comprising a bolt stop structure for obstructing movement of said locking bolt into the path of a prong entering the apparatus.

17. The apparatus of claim 14, wherein said slide bolt structure comprises two said locking bolts for engaging two prong openings, and wherein said face plate comprises:

face plate securing means for securing said face plate against a building wall;

at least two tubular prong passageways protruding perpendicular to and rearwardly from said face plate rear surface, encircling said prong passing ports, said passageways being sized in diameter to fit around and thus to receive plug prongs, and being sized in length to permit free ends of the plug prongs to extend beyond and protrude rearwardly out of said passageways.

18. The apparatus of claim 13, wherein said slide bolt structure comprises two said locking bolts for engaging two prong openings and wherein said slide bolt structure comprises:

a pair of opposing guide channels protruding rearwardly from said face plate rear surface and opening toward each other;

a bolt slide panel comprising a central panel portion and having two guide slats protruding from opposing edges of said central panel portion and fitting into said guide channels, said guide slats having a length such that said bolt structure has room within said guide channels to slide laterally within said guide channels;

and first and second electrical terminals laterally spaced apart from each other and secured to said bolt slide plate in electrical contact with said locking bolts such that said locking bolts protrude laterally from said terminals and are slidable simultaneously into and out of the prong openings; said electrical terminals being connectable to electrical wires external to said apparatus.

19. The apparatus of claim 18, wherein said bolt stop structure comprises:

a slat opening in each said guide channel;

and an anchor bar having two opposing anchor bar ends, each anchor bar end being bent to engagingly snap into one of said slat openings such that said anchor bar extends between said guide channels, said anchor bar having two substantially parallel and laterally spaced apart resilient stop arms extending from said anchor bar obstructing movement of said locking bolts behind said passageways when no prongs are in said passageways;

such that as the prongs are inserted into said passageways, the prongs bear against and deflect said stop arms rearwardly and out of the paths of and locking bolts.

20. The apparatus of claim 13, wherein said locking bolt constraining means comprises a slide bolt structure support flange extending rearwardly from said face plate rear surface.

* * * * *